US005901875A

United States Patent [19]

Flygenring

[11] Patent Number: 5,901,875

[45] Date of Patent: May 11, 1999

[54] SEPARATOR FOR USE IN PACKETS OF PAPERS

[76] Inventor: Robert George Flygenring, 26 Meadow Street, Papanui, Christchurch 8005, New Zealand

[21] Appl. No.: 08/750,362

[22] PCT Filed: Jun. 7, 1995

[86] PCT No.: PCT/NZ95/00052

§ 371 Date: Apr. 17, 1997

§ 102(e) Date: Apr. 17, 1997

[87] PCT Pub. No.: WO95/33667

PCT Pub. Date: Dec. 14, 1995

[30] Foreign Application Priority Data

Jun. 7, 1994 [NZ] New Zealand ..... 260695

[51] Int. Cl.[6] ..... B65H 1/08

[52] U.S. Cl. ..... 221/56; 221/34

[58] Field of Search ..... 221/34, 56, 58, 221/59, 33, 45, 279, 226; 206/449, 817, 215

[56] References Cited

U.S. PATENT DOCUMENTS

| | | | |
|---|---|---|---|
| 3,459,329 | 8/1969 | Mochizuki | 221/34 |
| 3,603,452 | 9/1971 | Singer | 206/45.16 |

FOREIGN PATENT DOCUMENTS

| | | |
|---|---|---|
| 28565/92 | 5/1993 | Australia . |
| 3602850 | 9/1986 | Germany . |

*Primary Examiner*—Kenneth Noland
*Attorney, Agent, or Firm*—Finnegan, Henderson, Farabow, Garrett & Dunner, L.L.P.

[57] ABSTRACT

A separator (1) is used in packets of papers. The separator comprises a folded resilient sheet with folds (2,3,4,5 and 6) substantially perpendicular to a longitudinal side edge of the sheet. The folds form a center apex (4) and at least two side apexes (2,6). The center apex (4) is adapted to fit in the center of a packet between windows (7 and 8) in a side wall of the packet (9). The two apexes are adapted to fit beneath the windows (7,8) and force paper in the packet against the windows.

7 Claims, 1 Drawing Sheet

SEPARATOR FOR USE IN PACKETS OF PAPERS

FIELD OF THE INVENTION

The present invention relates to a separator for use in packets of papers.

DESCRIPTION OF THE PRIOR ART

Problems often arise in packets of papers such as cigarette rolling paper's when the packets have two windows. This is because once a number of papers have been removed, the protruding papers ends can fall inside the packet, due to the papers slipping away from the windows. This results in significant difficulty in extracting the remaining papers undamaged.

BRIEF SUMMARY OF THE INVENTION

It is an object of the present invention to provide a separator which will overcome the above disadvantage or which will at least provide the public with a useful choice.

According to one aspect of the present invention, there is provided a separator for use in packets of papers, the separator comprising a folded resilient sheet with folds substantially perpendicular to a longitudinal side edge of the sheet, the folds forming a centre apex and at least two side apexes, the centre apex is adapted to fit in the centre of a packet between windows in a side wall of the packet and the at least two apexes are adapted to fit beneath the windows and force papers in the packet against the windows.

The folds can be substantially perpendicular to the longitudinal side edges of the separator.

The folds can be positioned at points substantially 20%, 40%, 50%, 60% and 80% across the sheet.

The separator can be folded upwards along the folds at points substantially 20%, 50% and 80% across the sheet.

The separator can be made of any suitable material such as a plastics or cardboard material. The material is preferably inexpensive to produce, biodegradable and resilient.

The separator can be used in any packet where two or more windows are provided through which papers are extracted. Preferably, the separator is used in packets of cigarette rolling papers.

BRIEF DESCRIPTION OF DRAWINGS

Further aspects of the invention will become apparent from the following description which is given by way of example with reference to the accompanying drawings.

DETAILED DESCRIPTION

Figure 1:
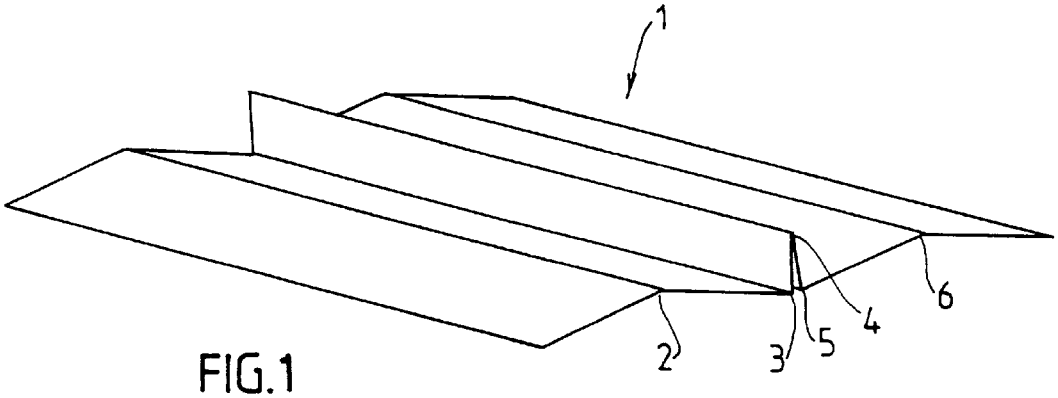
FIG. 1 shows a perspective view of the separator according to one embodiment of the present invention.
Figure 2:
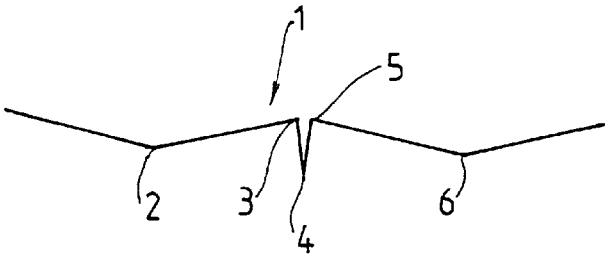
FIG. 2 shows a side view of the embodiment shown in FIG. 1.
Figure 3:
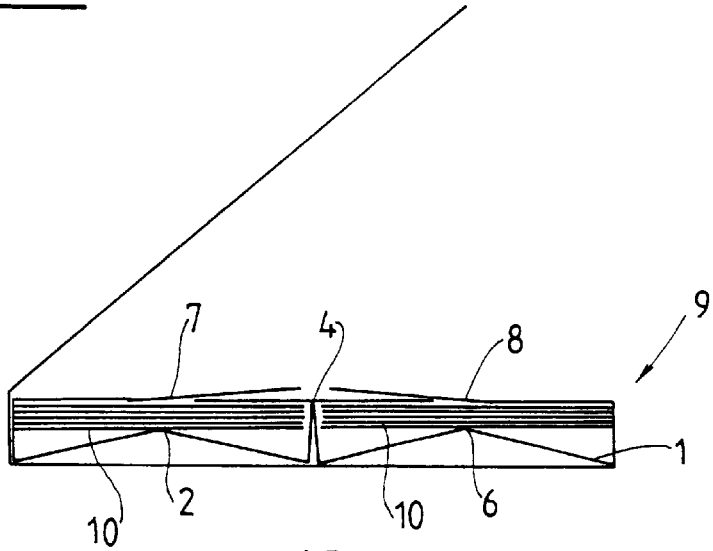
FIG. 3 shows the separator in a packet.

Referring firstly to FIGS. 1 and 2, it will be seen that the separator 1 is a folded sheet. Folds 2, 3, 4, 5 and 6 are perpendicular to the longitudinal side edge of the sheet 1. The folds are preferably made at points substantially 20%, 40%, 50%, 60% and 80% across the sheet. However, it is to be appreciated that these positions can be varied without departing from the scope of the invention.

When the sheet is folded, apexes are formed at fold points 2, 4 and 6.

In use, the separator 1 is placed under windows 7 and 8 in a packet 9, so the apex at foldline 4 is in the centre of the packet 9, locating the papers 10 in their individual stacks.

When the packet of papers is new, the full stacks of papers force the apexes formed at the folds 2 and 6, to lie substantially flat. As papers are used from the packet 9, pressure from the resilient apexes at foldlines 2 and 6, holds the diminishing stacks of papers 10 against the windows 7 and 8 in the packet 9.

To optimise the pressure exerted at the apexes at fold lines 2 and 6 the length of these folds may be reduced by appropriately chamfering the four corners of the separator. Accordingly, the papers 10 will be able to be extracted more consistently through the windows 7 and 8.

It will be appreciated the separator may be constructed from any suitable material. However, resilient plastic materials and cardboard are preferred.

It will also be appreciated that the separator can be used in any packet where two or more windows are provided to extract goods such as sheets of paper.

It will thus be seen that the present invention provides a separator for use in packets of papers.

Where in the aforegoing description, reference has been made to integers or components having known equivalents, then such equivalents are herein incorporated as if individually set forth.

Although this invention has been described by way of example and with reference to possible embodiments thereof, it is to be appreciated that improvements and/or modifications may be made thereto without departing from the scope or spirit of the invention as described herein and in the appended claims.

I claim:

1. A separator for use in a packet of papers, the packet of papers including two windows in a wall thereof through which windows papers can be dispensed, the separator comprising a folded resilient sheet with at least five generally parallel folds formed substantially perpendicular to a side edge of the sheet, wherein a centre fold forms a centre apex and two of the other folds form side apexes, wherein the centre fold is adapted to fit between the two windows in the packet of papers and the side apexes are adapted to fit under the windows, so that stacks of papers placed on each side of the centre apex are forced towards the windows.

2. A separator as claimed in claim 1 wherein the folds are substantially perpendicular to a longitudinal side edge of the sheet.

3. A separator as claimed in claim 2 wherein the folds are provided at points substantially 20%, 40%, 50%, 60% and 80% across the sheet.

4. A separator as claimed in claim 3 wherein the centre apex is at the mid point fold and the side apexes are provided at the points 20% and 80% across the sheet.

5. A separator as claimed in claim 4 wherein the sheet is constructed from a plastics or cardboard material.

6. A separator as claimed in claim 5 wherein the separator is used in any packet where two or more windows are provided through which papers are extracted.

7. A packet of papers including two windows in a wall thereof through which windows papers can be dispensed, wherein the packet further includes a separator, the separator including a folded resilient sheet with at least five generally parallel folds formed substantially perpendicular to a side edge of the sheet, wherein a centre fold forms a centre apex and two other folds form side apexes, wherein the centre fold is adapted to fit between the two windows in the packet of papers and the side apexes are adapted to fit under the windows, so that stacks of papers placed on each side of the centre apex are forced towards the windows.

* * * * *